US005743817A

United States Patent [19]

Yamagishi et al.

[11] Patent Number: 5,743,817

[45] Date of Patent: Apr. 28, 1998

[54] GOLF BALL

[75] Inventors: Hisashi Yamagishi; Yoshinori Egashira; Hideo Watanabe, all of Chichibu, Japan

[73] Assignee: Bridgestone Sports Co., Ltd., Tokyo, Japan

[21] Appl. No.: 536,049

[22] Filed: Sep. 29, 1995

[30] Foreign Application Priority Data

Oct. 14, 1994 [JP] Japan ..... 6-276109
Dec. 14, 1994 [JP] Japan ..... 6-333024

[51] Int. Cl.[6] ..... A63B 37/06; A63B 37/12

[52] U.S. Cl. ..... 473/377; 473/351; 473/385

[58] Field of Search ..... 473/372, 373, 473/351, 377, 385, 370, 374, DIG. 22

[56] References Cited

U.S. PATENT DOCUMENTS 4,858,924 8/1989 Saito et al. ..... 473/373
4,919,434 4/1990 Saito ..... 473/376
5,304,608 4/1994 Yabuki et al. ..... 473/372 X
5,516,110 5/1996 Yabuki et al. ..... 473/372

FOREIGN PATENT DOCUMENTS 2276628 10/1994 United Kingdom .

*Primary Examiner*—George J. Marlo
*Attorney, Agent, or Firm*—Sughrue, Mion, Zinn, Macpeak & Seas, PLLC

[57] ABSTRACT

A solid golf ball comprising a core and a cover is provided. The core has a core hardness expressed by a distortion of 2.2–4.0 mm under a load of 100 kg. The core hardness divided by the ball hardness ranges from 1.0 to 1.3. The cover has a thickness of 1.3–1.8 mm. The ball is improved in feel and spin while maintaining the flying distance inherent to solid golf balls.

2 Claims, 1 Drawing Sheet

GOLF BALL

BACKGROUND OF THE INVENTION

1. Field of the Invention

This invention relates to a solid golf ball having improved feel and spin performance.

2. Prior Art

As compared with wound golf balls, two-piece golf balls and other solid golf balls are advantageous in gaining a flying distance since they fly along the trajectory of a straight ball when hit by both drivers and irons. This advantage is mainly attributable to their structure. Because of their configuration less receptive to spin, the solid golf balls are given a straight ball trajectory and yield a more run, resulting in an increased total flying distance.

In turn, the solid golf ball tends to draw a "flier" path on an iron shot since it is less receptive to spin and does not readily stop on the green. Because of such characteristics, the two-piece balls are not preferred by experienced players.

Therefore, there is a need for a solid golf ball having improved spin properties and allowing the player to aim the pin dead with an iron. The increased flying distance inherent to the solid golf ball should be maintained and of course, the ball should have a pleasant feel.

SUMMARY OF THE INVENTION

Therefore, an object of the present invention is to provide a solid golf ball such as a two-piece golf ball which is improved in feel, spin properties and iron control without detracting from the trajectory and flying distance inherent to the solid golf ball. The term iron control is the controllability of a ball on an iron shot, more specifically stop on the green.

Briefly stated, the present invention pertains to a solid, typically two-piece, golf ball comprising a core and a cover enclosing the core. The hardness of the core, cover and ball are referred to as core hardness, cover hardness, and ball hardness, respectively. According to the invention, the core hardness is such that the core undergoes a distortion of at least 2.2 mm under a load of 100 kg. The core hardness divided by the ball hardness is in the range of 1.0 to 1.3. The cover has a radial thickness of 1.3 to 1.8 mm. This parameter control leads to a golf ball satisfying the requirements of flying distance, feel and spin.

Consider the spin mechanism of golf balls made of the same materials, but changed in hardness. Provided that the club head speed and the cover material are identical, the coefficient of friction between the ball and the club face is identical and hence, an identical frictional force is exerted therebetween. Only distortion is different due to differential hardness. Then the distance between the center of gravity and the ball-club contact point is different. The harder the ball, the longer is the contact point distance. The softer the ball, the shorter is the contact point distance. Then harder balls are more receptive to spin.

The spinning mechanism associated with an iron suggests that the spin quantity can be increased by increasing the ball hardness. Increasing the ball hardness, however, gives a harder feel, exacerbating the hitting feel. The spin quantity can also be increased by making the cover softer. A softer cover, however, deprives the ball of repulsion, resulting in a loss of initial speed and flying distance.

Attempting to increase the spin quantity for improving spin properties by using a soft material, typically a material having a Shore D hardness of 60 or lower as the cover, we found that a low hardness cover lowers repulsion, resulting in a loss of flying distance on hitting. Quite unexpectedly, we have found that by adjusting the core hardness to a distortion of at least 2.2 mm under a load of 100 kg, the ratio of core hardness to ball hardness to range from 1.0 to 1.3 and the cover thickness to range from 1.3 mm to 1.8 mm, the golf ball, whose cover is made of a softer material, is improved in iron control (that is, stop on the green) without deterring the feel and flying distance and without losing the trajectory and flying distance on a driver shot inherent to solid golf balls.

DETAILED DESCRIPTION OF THE PREFERRED EMBODIMENTS

Figure 1:
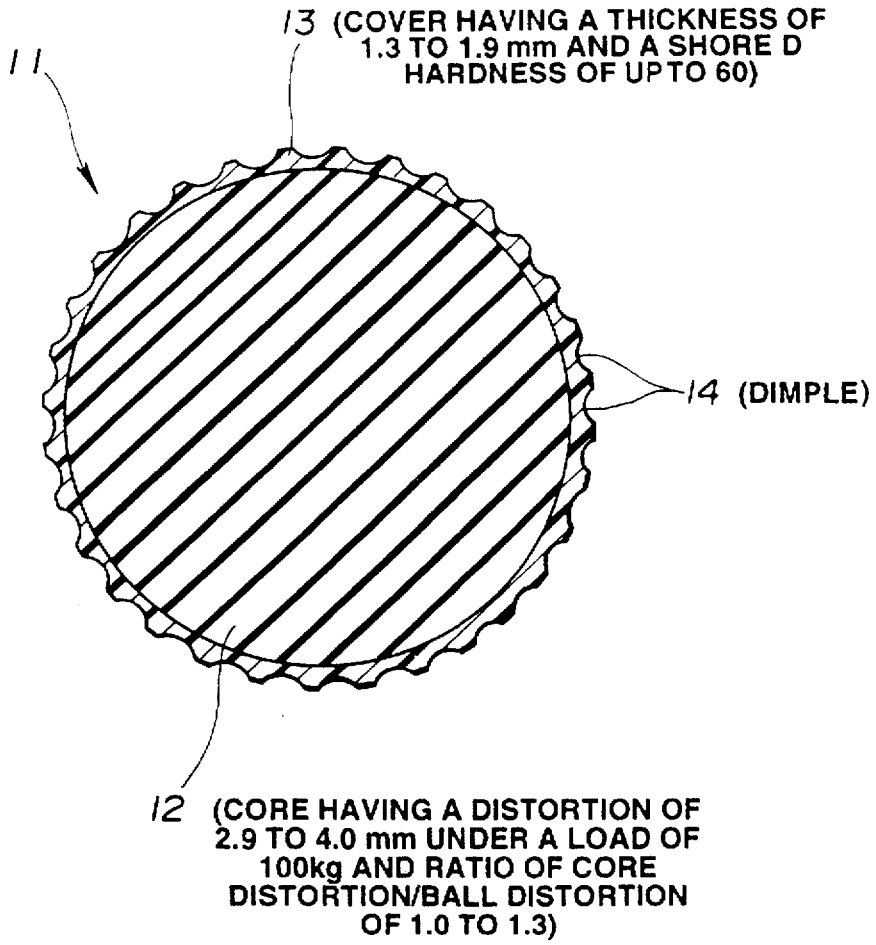
FIG. 1 is a schematic cross section illustrating one embodiment of the golf ball of the present invention.

In the golf ball comprising a spherical solid core enclosed in a cover according to the present invention, the core hardness is at least 2.2 mm as expressed by a distortion under a load of 100 kg, the core hardness divided by the ball hardness is in the range of 1.0 to 1.3 and the cover has a thickness of 1.3 to 1.8 mm.

The core hardness and ball hardness are defined by distortions (in mm) of the core and ball under a load of 100 kg, respectively. The core hardness corresponds to such a distortion of at least 2.2 mm, preferably at least 2.5 mm, more preferably 2.5 to 4.0 mm, most preferably 3.0 to 4.0 mm. With a core distortion of less than 2.2 mm, the feel becomes unpleasant. Too much core distortions would result in balls having poor restitution, low flying performance and a too soft feel. By controlling the core hardness/ball hardness so as to fall in the range between 1.0 and 1.3, especially between 1.0 and 1.25, the solid golf ball, typically two-piece golf ball is improved in feel, flying distance and spin characteristics. If the core hardness/ball hardness is less than 1.0, the feel becomes unpleasant. If the core hardness/ball hardness exceeds 1.3, the ball loses a quick stop on the green.

It is understood that the golf ball of the invention is advantageously applied to two-piece golf balls having a single core. It is also applicable to multi-core golf balls having a core consisting of two or more layers, such as three-piece golf balls. In an example where the core consists of two inner and outer layers, the core hardness refers to the hardness of the spherical two-layer core as a whole. Differently stated, the core hardness refers to the hardness of an entire spherical core left after removing the cover from the ball.

The cover has a Shore D hardness of up to 60, especially 55 to 60. A cover hardness of more than 60 would adversely affect spin characteristics and stop on the green. Since a cover with too low hardness would result in poor repulsion and a loss of flying distance, the lower limit of 55 is recommended for the cover hardness.

According to the invention, the cover has a radial thickness of 1.3 to 1.8 mm, especially 1.4 to 1.8 mm. Outside the range, the objects of the invention cannot be achieved. A cover of thinner than 1.3 mm is less resistant against top damage and liable to be broken. A cover of thicker than 1.8 mm leads to losses of repulsion and flying performance and gives a dull feel.

In general, the flying distance the ball covers depends on the head speed. The flying distance is reduced by a change from a higher head speed to a lower head speed. The degree of reduction of the flying distance by a change from a higher head speed to a lower head speed can be suppressed by limiting the cover thickness to the above-defined range. Differently stated, the dependency of flying distance on head speed is alleviated. Therefore, the ball of the invention is suitable for senior and female players who swing at a relatively low head speed.

In one preferred embodiment of the invention, the golf ball has a spin factor of 1.0 to 1.5. The spin factor is defined as follows. The golf ball has a spin quantity when hit by a pitching wedge (referred to as wedge spin quantity) and a spin quantity when hit by a driver (referred to as driver spin quantity). The spin factor is obtained by dividing the ratio of the wedge spin quantity to the driver spin quantity by the ball hardness. Then a spin factor smaller than unity means that the ball has greater spin with the driver and less spin with the pitching wedge. The former indicates that the trajectory is lofted and the flying distance is reduced. The latter indicates that when hit with an iron, the ball draws a flier-like trajectory and flies too much. A greater spin factor is then desirable. Then the object of the invention to render the ball receptive to less spin with a driver and more spin with an iron is effectively accomplished. However, a too greater spin factor would exacerbate ball control on an iron shot because the ball can be moved back too much due to back spin. For this reason, the spin factor is preferably in the range between 1.0 and 1.5.

The golf ball of the invention is advantageously applied to two-piece golf balls while it is also applicable to multi-core golf balls such as three-piece golf balls. The material and preparation of the core and cover are not critical. The components may be made of any of well-known materials insofar as the requirements of the invention are met. Of course, the golf ball of the invention has a standard size and weight.

More particularly, the core of the present solid golf ball is formed from a rubber composition by a conventional method while properly adjusting the component proportion and vulcanizing conditions. The core composition generally includes a base rubber, a crosslinking agent, a co-crosslinking agent, an inert filler, and other components. The base rubber may be selected from natural and synthetic rubbers conventionally used in the manufacture of solid golf balls. Preferably the base rubber is 1,4-polybutadiene rubber containing at least 40% of cis-configuration, optionally in admixture with natural rubber, polyisoprene rubber or styrene-butadiene rubber. The crosslinking agent is preferably selected from organic peroxides such as dicumyl peroxide and di-t-butyl peroxide, with the dicumyl peroxide being more preferred. Preferably the crosslinking agent is blended in an amount of about 0.5 to 3 parts, more preferably about 0.8 to 1.5 parts by weight per 100 parts by weight of the base rubber. Non-limiting examples of the co-crosslinking agent include metal salts of unsaturated fatty acids, especially zinc and magnesium salts of unsaturated fatty acids having 3 to 8 carbon atoms, such as acrylic acid and methacrylic acid. Zinc acrylate is the most preferred salt. The co-crosslinking agent is preferably blended in an amount of about 24 to 38 parts, more preferably about 28 to 34 parts by weight per 100 parts by weight of the base rubber. Examples of the inert filler include zinc oxide, barium sulfate, silica, calcium carbonate, and zinc carbonate, with the zinc oxide being most often used. The amount of the filler blended depends on the desired specific gravity of the core and cover, ball weight, and other factors although it generally ranges from about 10 to about 60 parts by weight per 100 parts by weight of the base rubber.

These components are blended to form a core-forming rubber composition which is kneaded by means of a conventional kneading machine such as a Banbury mixer and roll mill and then compression or injection molded in a spherical mold cavity. The molded composition is cured by heating it at a sufficient temperature for the crosslinking and co-crosslinking agents to exert their function (for example, about 130° to 170° C. when the crosslinking agent is dicumyl peroxide and the co-crosslinking agent is zinc acrylate). In this way, a solid spherical core having a diameter of 37 to 40 mm is prepared.

In the case of a two layer core, the inner core may be made of the same composition as above and the outer core may be made of a similar rubber composition or a resin composition based on an ionomer resin or the like. The outer core may be formed by compression molding or injection molding it around the inner core. Typically the inner core has a diameter of 27.0 to 38.0 mm, preferably 28.0 to 36.0 mm and the outer core has a diameter of 0.5 to 6.5 mm, preferably 1.5 to 5.5 mm, and the total diameter ranges from 37 to 40 mm.

The solid core is enclosed with the cover by any desired technique, for example, by enclosing the core in a pair of semi-spherical shell halves followed by heat compression molding. Alternatively the core is directly covered with a cover material by injection molding. By properly selecting the material and amount of the core and cover and preparation conditions such as vulcanizing conditions, a golf ball satisfying the requirements of the invention can be prepared.

There has been described a golf ball which is improved in feel and spin characteristics while maintaining the flying distance inherent to solid golf balls and which undergoes a lower degree of reduction of its flying distance upon hitting at a lower head speed.

EXAMPLE

Examples of the present invention are given below by way of illustration and not by way of limitation.

Examples 1–6 and Comparative Examples 1–2

Cores having a hardness as shown in Table 1 were molded by vulcanizing in a mold rubber compositions comprising cis-1,4-polybutadiene rubber, zinc acrylate, zinc oxide, and dicumyl peroxide. The core hardness reported is a distortion in millimeter under a load of 100 kilograms.

The cores were enclosed with covers which were formed from mixtures of ionomer resins. The blending proportion of ionomer resins was changed to form covers having varying hardness (Shore D scale) as shown in Table 2. In this way, there were obtained large-size two-piece golf balls having a hardness as shown in Table 3. The ball hardness reported is again a distortion in millimeter under a load of 100 kilograms.

The base composition for the core consisted of the following components.

| | Parts by weight |
|---|---|
| cis-1,4-polybutadiene rubber (BR01) | 100 |
| zinc acrylate | 33.2 |
| zinc oxide | 10 |
| barium sulfate | 9.7 |
| anti-oxidant | 0.2 |
| dicumyl peroxide | 0.9 |

Cores having varying hardness and specific gravity were obtained by varying the amounts of zinc acrylate and barium sulfate as shown in Table 1.

TABLE 1

| Core hardness | Cover gage 1.4 mm | 1.6 mm | 1.8 mm | 2.0 mm | 2.4 mm |
|---|---|---|---|---|---|
| 2.48–2.50 mm | 33.0 | 33.0 | 33.0 | 33.0 | |
| | 6.4 | 7.5 | 8.6 | 9.7 | |
| 2.88–2.91 mm | 31.0 | 31.0 | 31.0 | 31.0 | 31.0 |
| | 7.8 | 8.8 | 9.9 | 11.0 | 13.9 |
| 3.25–3.30 mm | 28.0 | 28.0 | 28.0 | 28.0 | |
| | 9.1 | 10.2 | 11.2 | 12.3 | |

At the upper and lower stages for each core hardness and cover gage combination, the amounts of zinc acrylate and barium sulfate are reported in parts by weight, respectively.

The base composition for the cover was a 50/50 (by weight) mixture of ionomer resins, Himilan 1650 and Surlyn 8120. Covers having varying hardness were obtained while blending Himilan 1650 and Surlyn 8120 in a ratio as shown in Table 2.

TABLE 2

| Cover hardness (Shore D) | Resin mix | Weight ratio |
|---|---|---|
| 56 | H1650/S8120 | 40/60 |
| 57 | H1650/S8120 | 50/50 |
| 65 | H1605/H1706 | 50/50 |

* H: Himilan commercially available from du Pont-Mitsui Polychemical Co., Ltd.
S: Surlyn commercially available from E. I. duPont The golf balls were examined for fly, stop on the green, and feel by the following procedures.

Fly Test

Using a swing robot manufactured by True Temper Co., the ball was hit by a driver at a head speed (HS) of 45 m/s and by an iron at a head speed of 35 m/s to measure the flying distance.

Stop on the Green Test

Using a swing robot manufactured by True Temper Co., the ball was hit by a pitching wedge at a head speed of 35 m/s so as to fly directly on the green. The distance between the landing and stop positions was measured. A negative value is the distance the ball covers due to back spin. A positive value is a run in a flying direction. The stop on the green was rated "O" for quick stop and "X" for non-stopping.

Feel Test

In a sensory test, a player hit the ball at a head speed (HS) of 35 m/s. The ball feel was rated "very soft", "soft" or "hard".

Note that the dependency of flying distance on head speed is expressed by the flying distance at a head speed of 35 m/s divided by the flying distance at a head speed of 45 m/s and simply reported under the heading "HS35/HS45" in Table 3.

TABLE 3

| | Example 1 | 2 | 3 | 4 | 5 | 6 | Comparative Example 1 | 2 |
|---|---|---|---|---|---|---|---|---|
| Core hardness (mm) | 2.48 | 3.30 | 2.50 | 2.90 | 2.91 | 3.25 | 2.10 | 2.85 |
| Ball hardness (mm) | 2.36 | 3.10 | 2.30 | 2.71 | 2.65 | 2.90 | 1.90 | 2.10 |
| Core/ball hardness ratio | 1.05 | 1.06 | 1.09 | 1.07 | 1.10 | 1.12 | 1.11 | 1.36 |
| Cover thickness (mm) | 1.4 | 1.4 | 1.6 | 1.6 | 1.8 | 1.8 | 1.8 | 2.4 |
| Cover hardness (Shore D) | 56 | 57 | 56 | 56 | 56 | 57 | 57 | 65 |
| Feel @ HS35 | soft | very soft | soft | very soft | soft | very soft | hard | soft |
| Flying distance (m) | | | | | | | | |
| @ HS 35 | 154 | 160 | 154 | 158 | 157 | 159 | 147 | 148 |
| @ HS 45 | 234 | 237 | 232 | 233 | 233 | 236 | 228 | 235 |
| Stop on the green | | | | | | | | |
| Landing-to-stop distance (m) | −0.5 | 0.5 | 0.0 | 0.0 | 0.0 | 0.5 | 0.0 | 2.5 |
| Rating | o | o | o | o | o | o | o | x |
| HS35/HS45 | 0.658 | 0.675 | 0.664 | 0.678 | 0.674 | 0.673 | 0.645 | 0.630 |

Although some preferred embodiments have been described, many modifications and variations may be made thereto in the light of the above teachings. It is therefore to be understood that within the scope of the appended claims, the invention may be-practiced otherwise than as specifically described.

We claim:

1. A golf ball comprising a core and a cover wherein said core and said ball has a core hardness and a ball hardness respectively, wherein said core has a distortion of 2.9 to 4.0 mm under a load of 100 kg, the ratio of a core distortion under a load of 100 kg divided by a ball distortion under a load of 100 kg ranges from 1.0 to 1.3, and said cover consists of an ionomer resin as a resin component and has a thickness of 1.3 to 1.8 mm and a Shore D hardness of up to 60.

2. The golf ball of claim 1 wherein said cover has a thickness of 1.6 to 1.8 mm.

* * * * *